US006968138B2

(12) United States Patent
Akutsu

(10) Patent No.: US 6,968,138 B2
(45) Date of Patent: Nov. 22, 2005

(54) DEVELOPER SEAL MEMBER AND DEVELOPING APPARATUS USING THE SEAL

(75) Inventor: Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 10/439,246

(22) Filed: May 16, 2003

(65) Prior Publication Data

US 2004/0001727 A1 Jan. 1, 2004

(30) Foreign Application Priority Data

May 21, 2002 (JP) ..... 2002-146060

(51) Int. Cl.[7] ..... G03G 15/08
(52) U.S. Cl. ..... 399/104
(58) Field of Search ..... 399/98, 102, 103, 399/104, 106

(56) References Cited

U.S. PATENT DOCUMENTS 5,084,733 A * 1/1992 Katoh et al. ..... 399/104
5,187,326 A * 2/1993 Shirai ..... 399/104
5,697,021 A * 12/1997 Watanabe et al. ..... 399/102
5,790,923 A 8/1998 Oguma et al. ..... 399/106
5,812,909 A 9/1998 Oguma et al. ..... 399/103
6,021,291 A 2/2000 Karakama et al. ..... 399/104
6,029,030 A 2/2000 Yamaji et al. ..... 399/104
6,032,007 A 2/2000 Yamaji et al. ..... 399/104
6,038,414 A * 3/2000 Inami et al. ..... 399/104
6,044,237 A * 3/2000 Numagami et al. ..... 399/104
6,104,894 A * 8/2000 Sato et al. ..... 399/106
6,151,467 A 11/2000 Yamaguchi ..... 399/104
6,160,976 A 12/2000 Karakama et al. ..... 399/104
6,205,304 B1 3/2001 Kawaguchi ..... 399/103
6,266,500 B1 7/2001 Numagami et al. ..... 399/104
6,336,015 B1 * 1/2002 Numagami ..... 399/104

* cited by examiner

*Primary Examiner*—Sandra L. Brase
(74) *Attorney, Agent, or Firm*—Fitzpatrick, Cella, Harper & Scinto

(57) ABSTRACT

A developing apparatus includes a roller-shaped developer carrying member, a frame for holding the developer carrying member, and a magnetic seal member for preventing leakage of a developer from an end of the developer carrying member in a longitudinal direction of the developer carrying member. The magnetic seal member includes an arcuate magnet portion to be disposed along a circumferential direction of the developer carrying member, and a non-arcuate portion which extends from an end, in the circumferential direction, of the magnet portion away from a peripheral surface of the developer carrying member and is different in material from the magnet portion.

18 Claims, 8 Drawing Sheets

DEVELOPER SEAL MEMBER AND DEVELOPING APPARATUS USING THE SEAL

FIELD OF THE INVENTION AND RELATED ART

The present invention relates to a developing apparatus for developing an electrostatic latent image formed on an electrophotographic photosensitive member and a magnetic seal member used in the developing apparatus.

In a conventional electrophotographic image forming apparatus which forms an image on a recording medium by employing an electrophotographic process, a process cartridge scheme wherein an electrophotographic photosensitive member and a plurality of process means acting on the photosensitive member are integrally supported to form a cartridge which is detachably mountable to a main body of the image forming apparatus, has been adopted. According to this process cartridge scheme, it is possible to perform maintenance o the apparatus by a user alone without relying on a service engineer, so that an operability can be greatly enhanced. For this reason, the process cartridge scheme has been employed widely in the image forming apparatus.

In a developing means (developing apparatus) incorporated in such a process cartridge, a seal member for preventing leakage of toner toward the outside of a developing area is disposed at both ends of a rotating developer carrying member (developing sleeve).

In the conventional image forming apparatus, an elastic member formed of, e.g., felt or foam rubber, has been widely utilized as the seal member for preventing the toner leakage.

However, in view of advantages such as a reduction of rotation torque of the developing sleeve, a stability of sealing ability and a recycling efficiency of the seal member, there has been proposed a method wherein at each of both ends of the developing sleeve, a seal member for preventing toner leakage by the action of magnetic force is disposed with a predetermined gap to the developing sleeve to prevent the toner leakage, as shown in, e.g., FIG. 8. Referring to FIG. 8, such a magnetic seal member 71' includes a magnet 73' which is an injection-molded product comprising a nylon binder containing a magnetic powder of Nd—Fe—B, and a magnetic plate 74' formed of an iron material. A gap g' between a developing sleeve 5' and the magnetic seal member 71' is 0.1–0.7 mm (as shown in (d) of FIG. 11). At that time, a magnetic flux density at the surface of the developing sleeve 5' given by magnetic force of the magnetic seal member 71' is about 1000–2000 Gs. Further, with respect to a positional relationship between the magnet 73' and the magnetic plate 74', as shown in FIG. 10, the magnet 73' is disposed on a side closer to an opening 26' of a developing device frame 12', and the magnetic plate 74' is disposed on a side opposite from the side closer to the opening 26'.

By this positional relationship between the magnet 73' and the magnetic plate 74', magnetic lines of force are formed between the magnet 73' and the magnetic plate 74', as shown in FIG. 3, and enter the magnetic plate 74' which has a high (magnetic) permeability. As a result, it is possible to prevent generation of magnetic lines of force extending out from a width of the magnetic seal member 71'. Further, the generated magnetic lines of force are concentrated at the magnetic plate 74', so that a resultant magnetic flux density at the surface of the magnet 73' is increased, thus creating a large magnetic force. As a result, a sealing performance of the magnetic sealing member 71' is improved.

Next, a method of mounting and positioning the magnetic sealing member 71' will be described.

As shown in FIG. 9, on an outer peripheral surface side (back side) of the magnet 73' and the magnetic plate 74', an elastic lining 77' of an elastic material is disposed. The elastic lining 77' has a width, in a longitudinal direction of the developing sleeve 5', which is substantially equal to a total of widths of the magnet 73' and the magnetic plate 74'. Further, the elastic lining 77' is disposed so that its lower (bottom) end surface on an outer side in the longitudinal direction of developing sleeve 5' (right-hand side on the figure) covers a lower end surface 71'*f* of the magnetic seal member and a lower end surface 77'*f* on an inner side (left-hand side on the figure) and the lower end surface 71'*f* of the magnetic seal member are substantially in one plane. On the other hand, an upper (top) end surface 77'*g* of the elastic lining 77' is located at a position somewhat below an upper end surface 73'*g* of the magnet 73'. The elastic lining 77' is applied to the backside of the magnet 73' and the magnet plate 74' with a double-faced (adhesive) tape.

Further, the developing device frame 12' is provided with a mounting groove 72' for mounting the magnetic seal member 71', which groove extending from a flat surface 12'*i* to an arcuate surface 12'*j* as shown in FIG. 10. The groove 72' includes an arcuate groove 72'*a* extended along an arcuation of the arcuate surface 12'*j*, a linear groove 72'*b* formed substantially vertically along the flat surface 12'*j*, and a positioning groove 72'*d*, formed in the longitudinal direction of the developing sleeve 5', with which a bent engage (fitting) portion 73'*e* of the magnetic seal member 71' is engaged. A vertical dimension 72'*x* of the positioning groove 72'*d* is slightly larger than a vertical dimension 73'*x* of the bent engage portion 73'*e* of the magnetic seal member 71'. By engaging the bent engage portion 73'*e* in the positioning groove 72'*d*, it is possible to perform positioning of the magnetic seal member 71' in a substantially vertical direction. A depth 72'*w* of the mounting groove 72' for mounting the magnetic seal member 71' is, as shown in (a) of FIG. 11, smaller than a thickness 71'*w* of the magnetic seal member 71' at its upper portion plus the thickness of the elastic lining 77' by a compression margin of the elastic lining 77'. Further, a lower end abutting portion 72'*f* to which the lower end surface 71'*f* of the magnetic seal member 71' directly abuts is formed at an inner portion of the lower end surface of the arcuate groove 72'*a* in the longitudinal direction of the developing sleeve 5'.

As shown in (a) of FIG. 11, the magnetic seal member 71' is engaged into the mounting groove 72' (for mounting the magnetic seal member 71') of the developing device frame 12' as indicated by an arrow. Then, a semicircular arcuate portion 71*a'* (FIG. 8) of the magnetic seal member 71' is fitted into the arcuate groove 72'*a*, and a linear surface portion 71'*b* (FIG. 8) of the magnetic seal member 71' is fitted into the linear groove 72'*b*, as shown in (b) of FIG. 11. When the magnetic seal member 71' is lightly pressed in a direction of an arrow B, a lower portion 77'*a* (FIG. 9) of the elastic lining 77' is compressed. At the same time, the lower end surface 71'*f* of the magnetic seal member 71' presses the lower end abutting portion 72'*f*, and an upper end surface 73'*g* (FIG. 8) of the magnetic seal member 71' (the magnet 73') is flush with an upper end surface 72'*g* of the groove 72'. Accordingly, when the upper portion of the magnetic seal member 71' is pushed toward the rear side in the direction crossing the arrow B, the magnetic seal member 71' is engaged with the groove 72'.

Then, a developing blade 9'*d* is mounted to the developing device frame 12'. When a plate 9'*d*1 of the developing blade 9'*d* is closely contacted to the flat (bearing) surface 12'*i* of the developing device frame 12', an upper front side 73'*h* of the magnet 73' is pressed by the plate 9'*d*1 of the developing blade 9' as shown in (c) of FIG. 11, whereby the upper portion of the magnetic seal member 71' is pressed into the groove 72'. This rotates the upper portion of the magnetic seal member 71' about the lower end surface 71'*f*, so that the elastic lining 77' is compressed rearwardly. The reaction force thereof is received by the lower end abutting portion 72'*f* of the groove 72' of the developing device frame 12' to which the lower end surface 71'*f* of the magnetic seal member 71' is contacted and by the plate 9'*d*1 to which the upper front side 73'*h* portion is contacted. Then, a developer roller unit G is mounted. This is shown in (d) of FIG. 11.

As a result, the magnetic seal member 71' is held by the mounting groove 72' (for mounting the magnetic seal member 71') provided in the developing device frame 12' and the upper portion thereof is pressed by the plate 9'*d*1 of the developing blade 9'*d*, thus being correctly positioned.

However, in such a mounting and positioning method as described above, the magnetic seal member 71' is made of the magnet not only at its arcuate portion but also its linear portion, thus leading to an increase in cost.

SUMMARY OF THE INVENTION

In view of the above problem, the present invention has been accomplished.

An object of the present invention is to provide a developing apparatus and a magnetic seal member, which are inexpensive while retaining a good toner sealing performance.

Another object of the present invention is to provide a developing apparatus to which a magnetic sealing member is readily mounted.

Another object of the present invention is to provide such a magnetic sealing member.

According to the present invention, there is provided a developing apparatus, comprising:

a roller-shaped developer carrying member, a frame for holding the developer carrying member, and a magnetic seal member for preventing leakage of a developer from an end of the developer carrying member in a longitudinal direction of the developer carrying member, the magnetic seal member including an arcuate magnet portion to be disposed along a circumferential direction of the developer carrying member, and a non-arcuate portion which extends from an end, in the circumferential direction, of the magnet portion away from a peripheral surface of the developer carrying member and is different in material from the magnet portion.

According to the present invention, there is also provided a magnetic seal member adapted to a developing apparatus, comprising:

an arcuate magnet portion to be disposed along a circumferential direction of a developer carrying member, and a non-arcuate portion which extends from an end, in the circumferential direction, of the magnet portion away from a peripheral surface of the developer carrying member and is different in material from the magnet portion.

The present invention provides a developing apparatus, comprising:

a roller-shaped developer carrying member, a frame for holding the developer carrying member, and a magnetic seal member for preventing leakage of a developer from an end of the developer carrying member in a longitudinal direction of the developer carrying member, the magnetic seal member including an arcuate magnet portion to be disposed along a circumferential direction of the developer carrying member, and a non-arcuate portion which extends from an end, in the circumferential direction, of the magnet portion away from a peripheral surface of the developer carrying member;

wherein the non-arcuate portion is elastically deformable.

The present invention also provides a magnetic seal member adapted to a developing apparatus, comprising:

an arcuate magnet portion to be disposed along a circumferential direction of a developer carrying member, and a non-arcuate portion which extends from an end, in the circumferential direction, of the magnet portion away from a peripheral surface of the developer carrying member;

wherein the non-arcuate portion is elastically deformable.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the embodiments of the present invention will be described in detail with reference to the drawings.

In the following description, however, a dimension, a material and a shape of respective constituent members, their relative arrangement, etc., may be appropriately modified and should be understood that the scope of the present invention is not restricted thereto unless otherwise specified.

Embodiment 1

Figure 7:
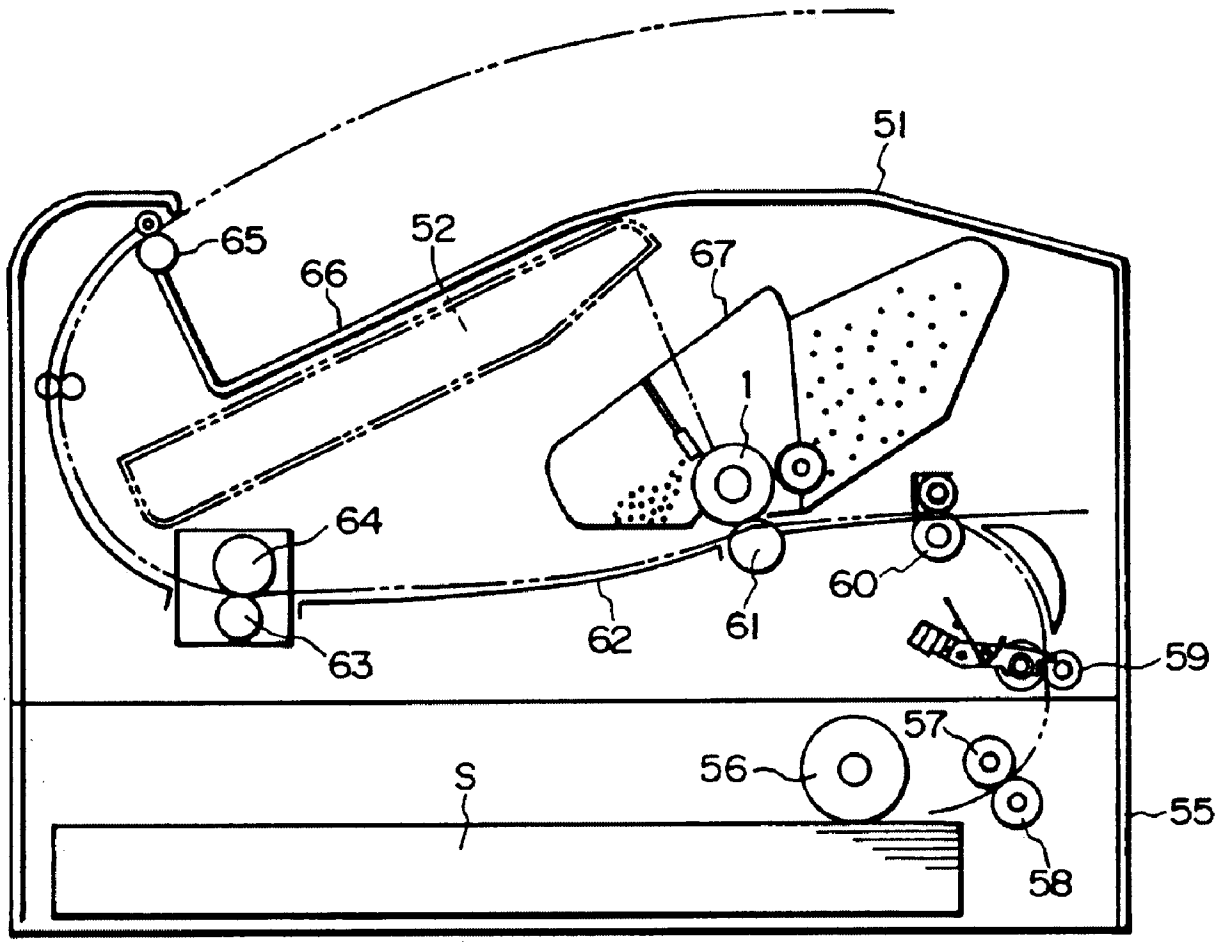
FIG. 7 is a sectional view illustrating principal parts of an image forming apparatus used in Embodiment 1.
Figure 8:
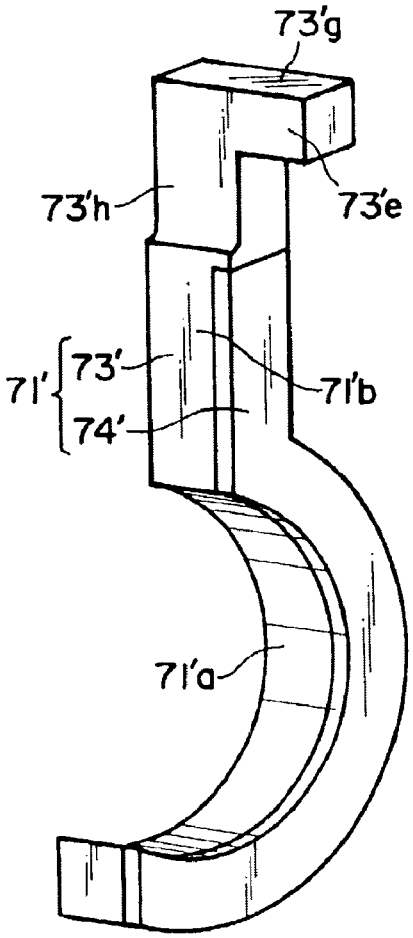
FIG. 8 is a perspective view of a conventional magnetic seal member.
Figure 9:
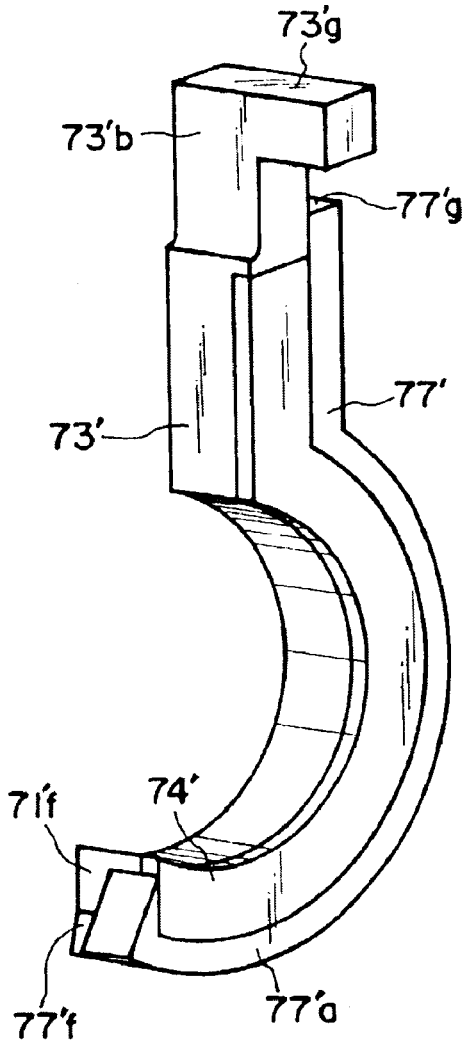
FIG. 9 is a perspective view of the conventional magnetic seal member to which an elastic lining is applied.
Figure 10:
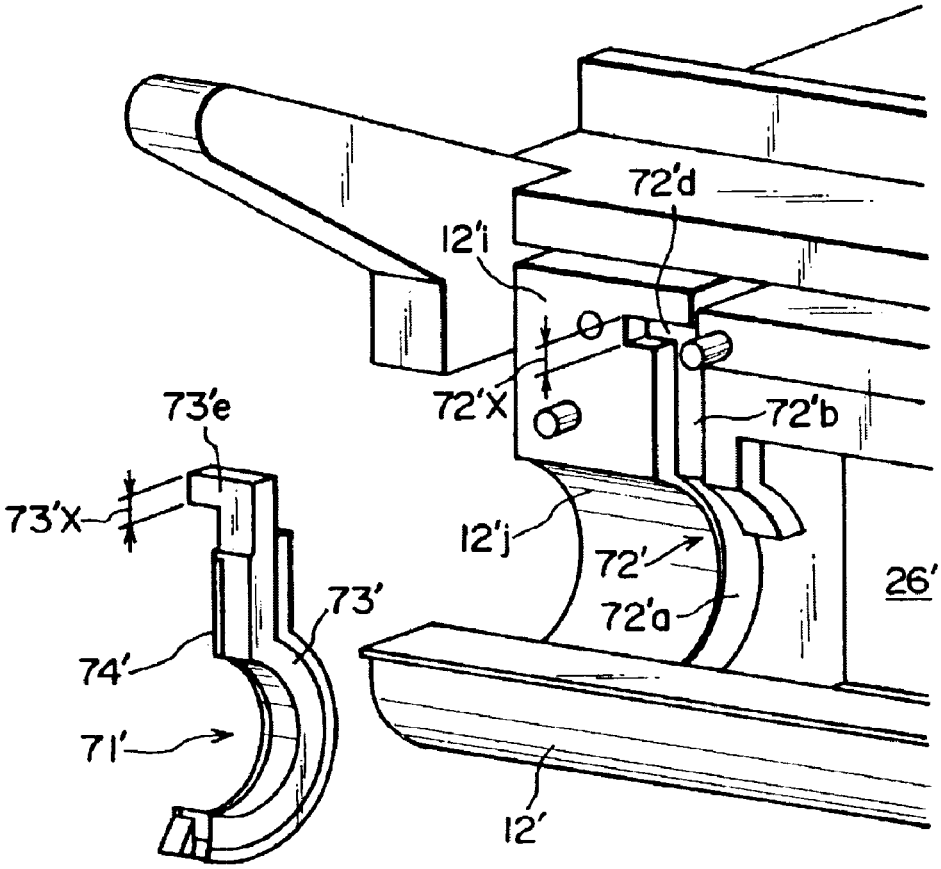
FIG. 10 is a perspective view of a mounting portion of the conventional magnetic seal member.

FIG. 7 shows a general structure of an image forming apparatus according to this embodiment.

Referring to FIG. 7, this image forming apparatus 51 (a laser beam printer in this embodiment) is an apparatus in which a latent image is formed on an electrophotographic photosensitive member 1 in the form of a drum (hereinafter referred to as a "photosensitive drum") by irradiating the photosensitive drum 1 with a laser beam based on image data by an optical system 52, and the latent image is developed with a toner (not shown) to form a toner image on the photosensitive drum 1.

Meanwhile, a sheet material S is placed in a sheet feeding cassette 55 and is conveyed to a main assembly of the apparatus 51 by picking up the sheet material S sheet by sheet by means of a sheet feeding mechanism including a pickup roller 56, a feed roller 57 and a retard roller 58. The sheet material S fed by the feeding mechanism is conveyed from a pair of conveyer rollers 59 to a pair of resister rollers 60 to align the sheet material S in order, and is conveyed to a transfer portion. At the transfer portion, the toner image formed on the above-mentioned photosensitive drum 1 is transferred onto the sheet material S by a transfer roller 61 as a transfer means. The sheet material S is then conveyed to a fixing means by guiding it on a guiding plate 62. The fixing means includes a pressure roller 63 and a fixing roller 64 containing a heater, and applies heat and pressure to the sheet material S which passes through the fixing means, so that the toner image having been transferred onto the sheet material S is fixed to the sheet material S. The sheet material S is conveyed farther by a pair of discharging rollers 65 to be discharged into a discharge portion 66 through a reversing path. Incidentally, the image forming apparatus 51 is capable of manually feeding the sheet material by manual feed tray and rollers (not shown).

Next, a process cartridge 67 detachably mountable to the image forming apparatus 51 described above will be explained with reference to FIG. 6, which illustrates a general structure of the process cartridge 67 used in this embodiment.

The process cartridge 67 includes a photosensitive drum 1 and at least one process means. Examples of the process means may include a charging means 2 for charging the surface of the photosensitive drum 1, a developing means (developing apparatus) 4 for forming a toner image on the photosensitive drum 1, and cleaning means 11 for removing a toner remaining on the photosensitive drum 1.

Figure 6:
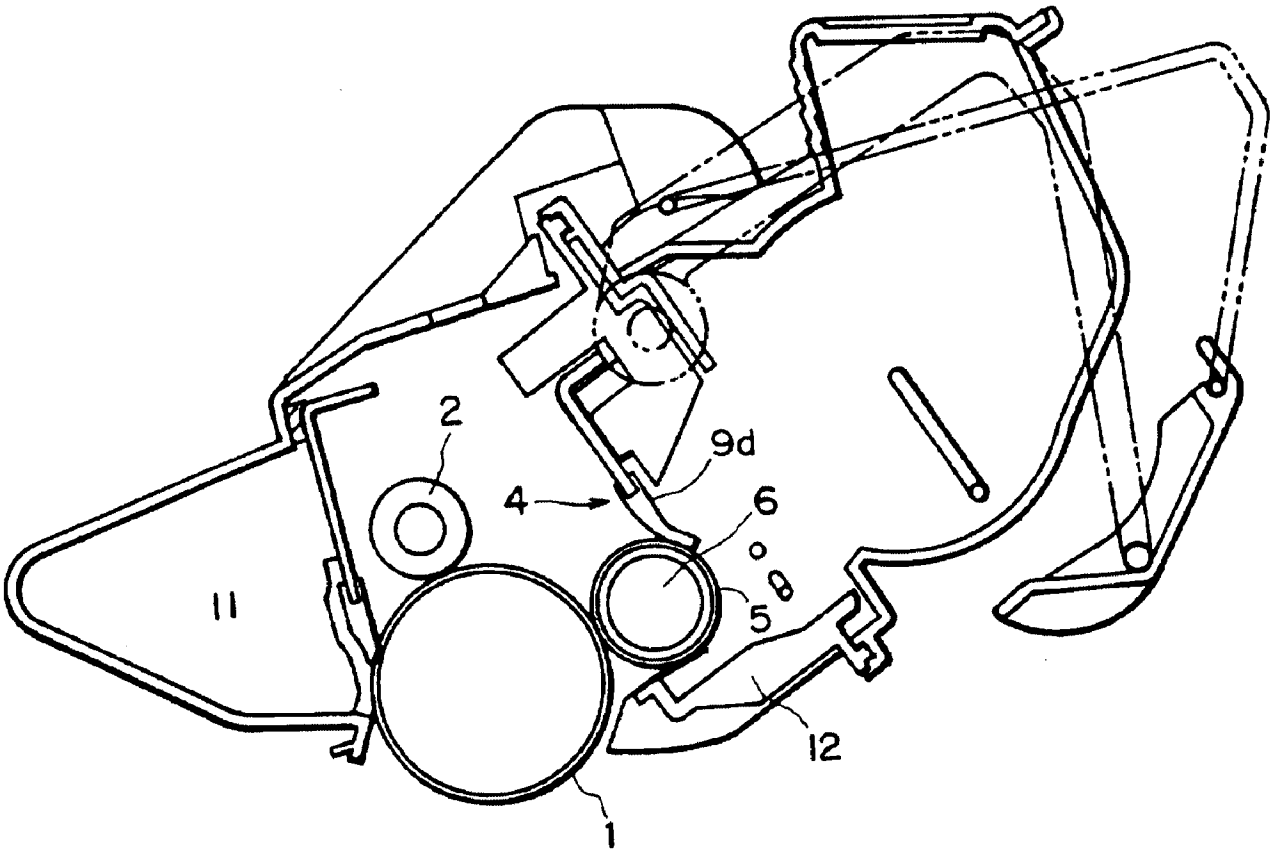
FIG. 6 is a schematic cross-section of a process cartridge according to Embodiment 1 of the present invention.

As shown in FIG. 6, the process cartridge according to this embodiment includes, around the photosensitive drum 1, the charging member 2, the developer device frame 12, the developing means including the developing sleeve 5 as an image bearing member and a developing blade 9*d*, and the cleaning means 11. These process means is covered with a housing which is formed by a frame to be integrally supported to provide a cartridge, which is detachably mounted to a main assembly of the image forming apparatus (not shown).

Hereinbelow, the developing means 4 according to this embodiment will be described.

The developing sleeve 5 include a magnetic roller 6 therein is rotatably mounted to the developing device frame 12 through a sleeve bearing (not shown). A toner supplied from the developing device frame 12 is attached to the surface of the developing sleeve 5 by a magnetic force of the magnetic roller 6 and is regulated to have a uniform thickness by the developing blade 9*d* which comprises a rubber blade and a D blade plate as a supporting plate for supporting the rubber blade. Thereafter, the toner is conveyed to a position opposite from a latent image on the photosensitive drum 1 by rotation of the developing sleeve 5 and is attached to the latent image to effect development.

Figure 5:
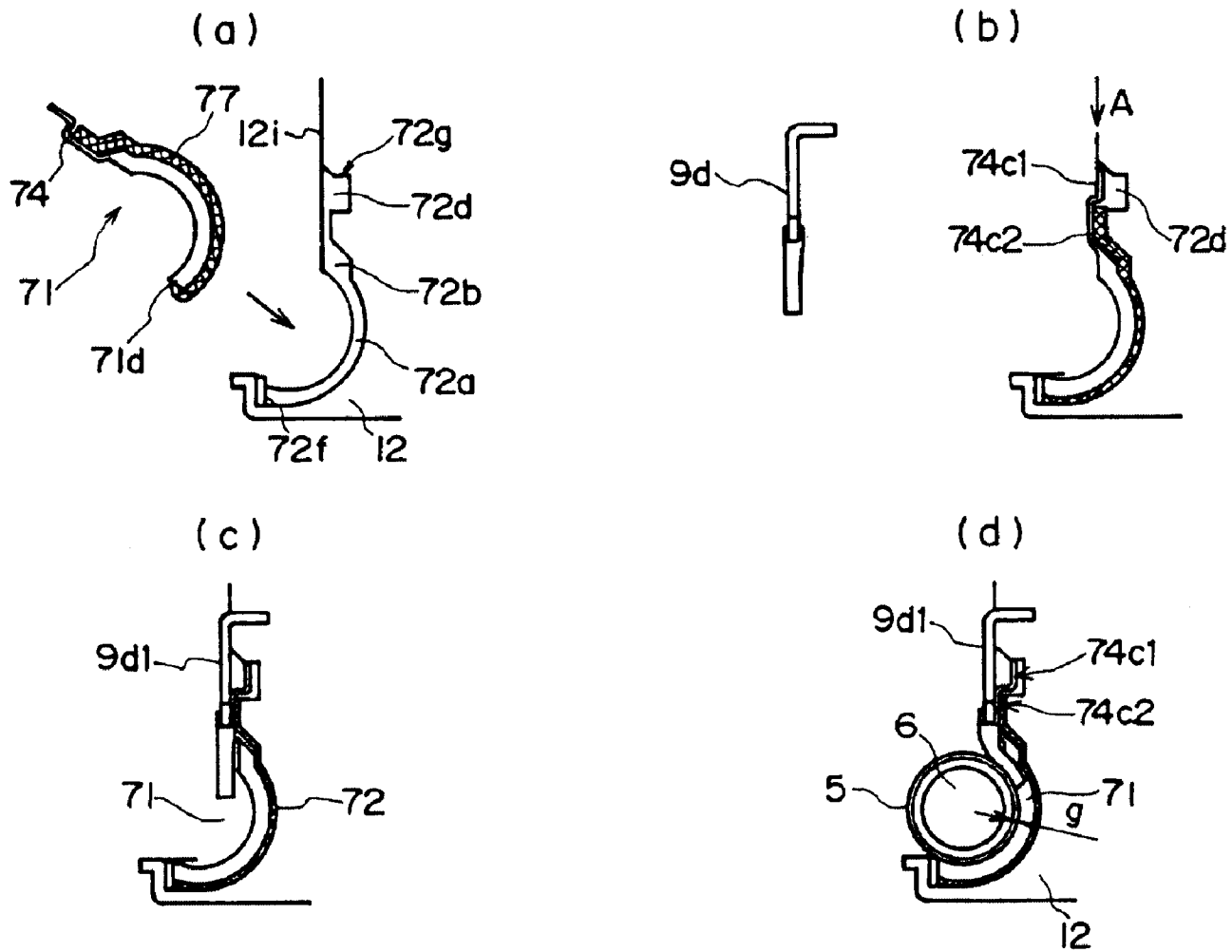
FIG. 5 is a side view illustrating mounting of the magnetic seal member according to Embodiment 1 to a developing device frame.

Further, the developing means 4 is provided with a magnetic seal member 71 at both end portions of the developing sleeve 5 in a longitudinal direction of the developing sleeve 5 as shown in (d) of FIG. 5. The magnetic seal member 71 is disposed with a gap g with respect to the peripheral surface of the developing sleeve 5 and is mounted to the developing device frame 12. The magnetic seal member 71 is prepared by bonding a magnetic plate (magnetic member) 74 to a magnet 73 at an outer side surface thereof in a width direction of the magnet 73.

Next, the magnetic seal member 71 used in this embodiment will be described in detail.

Figure 1:
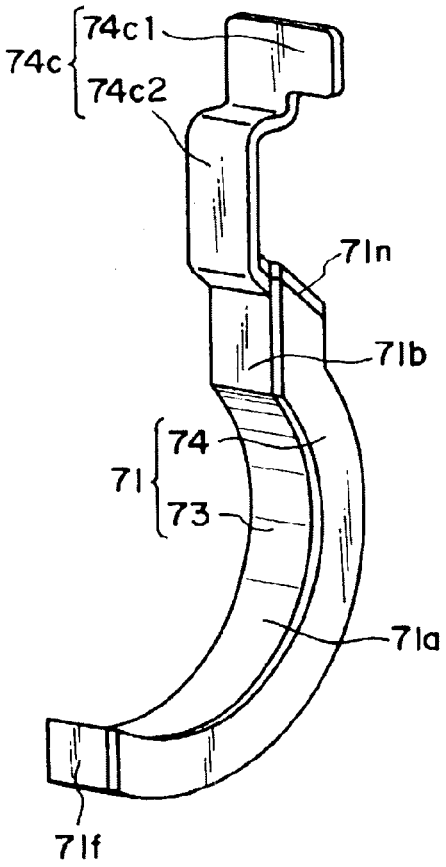
FIG. 1 is a perspective view of a magnetic seal member according to Embodiment 1 of the present invention.

The magnetic seal member 71 has a shape as shown in FIG. 1. Referring to FIG. 1, the magnetic seal member 71 includes a magnet (arcuate portion) 73 which is an injection-molded product having a width of 3.4 mm and comprising a nylon binder which contains a magnetic powder of Nd—Fe—B, and a 0.6 mm-thick magnetic plate 74 formed of an SUS (stainless steel) material. As described hereinafter, the magnetic seal member 71 includes the magnetic plate disposed at the side surface of the magnet 73 and a magnetic plate which is extended linearly from the upper (top) end portion and is integral with the magnetic plate on the side of the magnet 73. These magnetic plates are formed by bending a single magnetic plate. The thus bending-treated magnetic plate and the magnet are integrally molded in one piece to constitute the magnetic seal member. The gap g between a developing sleeve 5 and the magnetic seal member 71 is 0.1–0.7 mm (as shown in (d) of FIG. 5). At that time, a magnetic flux density at the surface of the developing sleeve 5 given by magnetic force of the magnetic seal member 71 is about 1000–2000 Gs. Further, with respect to a positional relationship between the magnet 73 and the magnetic plate 74 disposed at its side surface, the magnet 73 is disposed on a side closer to an opening 26 of a developing device frame 12, and the magnetic plate 74 is disposed on a side opposite from the side closer to the opening 26 (i.e., an outer side surface of the magnet in a longitudinal direction of the developing sleeve) at a portion extending from an arcuate portion 71*a* of the magnetic seal member 71 to a linear portion 71*b* above the arcuate portion 71*a*. Further, at a portion 74*c* (extending away from the peripheral surface of the developing sleeve) located above and other than the portions to be opposite to the developing sleeve 5, there is no magnet 73, and as shown in FIG. 1, the magnetic seal member 71 is formed only of the magnetic plate 74 at the portion 74*c*. The portion 74*c* (other than the portions to be opposite to the developer sleeve 5) has a function of positioning the above-mentioned magnetic seal member 71 relative to the above-mentioned developing device frame 12. The portion 74*c* includes a bent engage portion 74*c*1 for performing the positioning of the magnetic seal member 71 in a substantially vertical direction in FIG. 5 relative to the frame 12 (at its upper and lower end surfaces), and an abutting surface 74*c*2 for performing the positioning in a substantially horizontal direction in FIG. 5 by abutment with the D blade plate 9*d*1 (for supporting the developing blade).

The bent engage portion 74*c*1 is located in a position where it does not abut to the supporting plate 9*d*1 of the developing plate 9*d*. More specifically, the bent engage portion 74*c*1 is located in a depressed position relative to the abutting surface 74*c*1. By doing so, a positional relationship of the abutting surface 74*c*2 with other portions becomes clear, so that a surface accuracy of the abutting surface is readily ensured. In this regard, if the bent engage portion 74*c*1 and the abutting surface 74*c*2 are at the same level in the horizontal direction, it is necessary to design an angle between a flat surface 12: of the frame 12 for positioning the supporting plate 9*d*1 of the developing blade 9*d* and an upper end surface 72*g* (which determines a position of the magnetic seal member in a substantially vertical direction by abutment thereof with the upper end surface of the bent engage portion 74*c*1) of an engage (mounting) groove 72 (of the frame 12) for engaging the magnetic seal member therein, to be a right angle. As a result, the magnetic seal member 71 is not readily engaged into the frame 12. However, as in this embodiment, the bent engage portion 74*c*1 is designed to be in a depressed position relative to the abutting surface 74*c*2, whereby it is possible to locate the upper end surface 72*g* of the groove 72 away from the mounting flat surface 12*i* of the developing blade 9*d*. As a result, it is possible to form an oblique surface at a corner as shown in (a) of FIG. 5, thus facilitating engagement of the magnetic seal member 71 with the frame 12.

Figure 3:
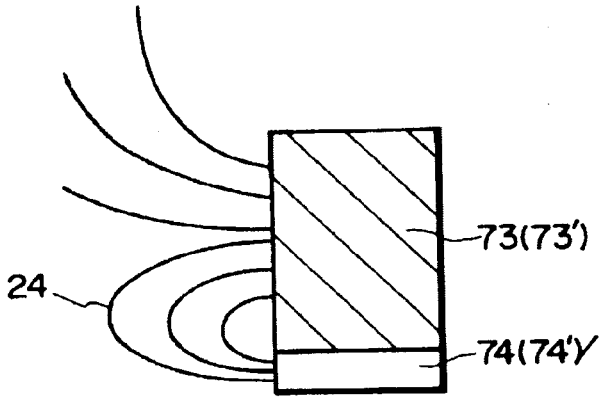
FIG. 3 is a sectional view illustrating a state of magnetic lines of force with respect to the magnetic seal member according to Embodiment 1.

Further, the portions of the magnetic seal member 71 to be opposite to the developing sleeve 5 are disposed so that the magnet is on the (inner) side closer to the opening 26 of the developing device frame 12 and the magnetic plate 74 is on the (outer) side opposite from the side closer to the opening 26. Accordingly, magnetic lines 24 of force are formed between the magnet 73 and the magnetic plate 74, as shown in FIG. 3, and enter the magnetic plate 74 which has a high (magnetic) permeability. As a result, it is possible to prevent generation of magnetic lines of force extending out from a width of the magnetic seal member 71. Further, the generated magnetic lines of force are concentrated at the magnetic plate 74, so that a resultant magnetic flux density at the surface of the magnet 73 is increased, thus creating a large magnetic force. As a result, a sealing performance of the magnetic sealing member 71 is improved.

Next, a method of mounting and positioning the magnetic sealing member 71 will be described.

Figure 2:
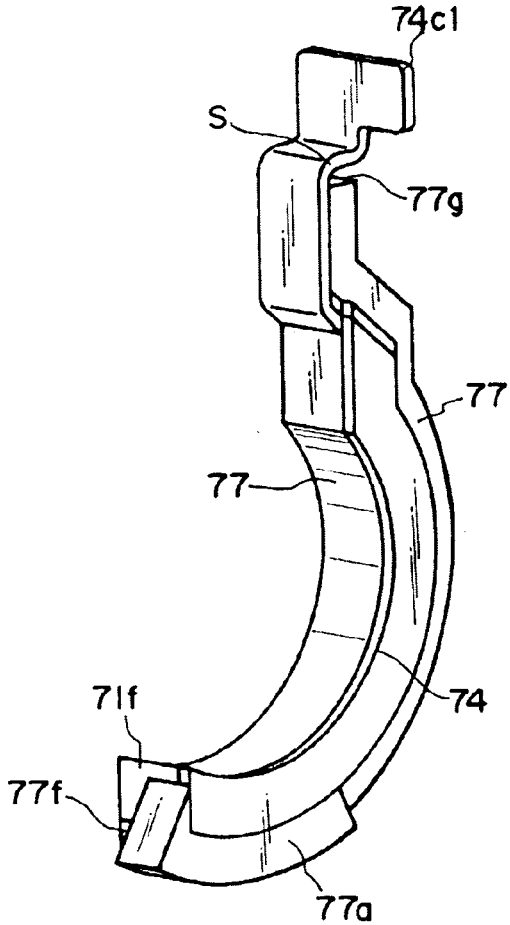
FIG. 2 is a perspective view of the magnetic seal member according to Embodiment 1 to which an elastic lining is applied.

As shown in FIG. 2, on an outer peripheral surface side (back side) of the magnet 73 and the magnetic plate 74, an elastic lining 77 of an elastic material is disposed. The elastic lining 77 has a width, in a longitudinal direction of the developing sleeve 5, which is substantially equal to a total of widths of the magnet 73 and the magnetic plate 74. Further, as shown in FIG. 1, the elastic lining 77 is disposed so that its lower (bottom) end surface on an outer side in the longitudinal direction of developing sleeve 5 (right-hand side on the figure) covers a lower end surface 71*f* of the magnetic seal member and a lower end surface 77*f* on an inner side (left-hand side on the figure) and the lower end surface 71*f* of the magnetic seal member are substantially in one plane. On the other hand, referring again to FIG. 2, an upper (top) end surface 77*g* of the elastic lining 77 is located at a position somewhat below an upper end surface 73*g* of the magnetic plate 74. The elastic lining 77 is applied to the backside of the magnet 73 and the magnet plate 74 with a double-faced (adhesive) tape.

Figure 4:
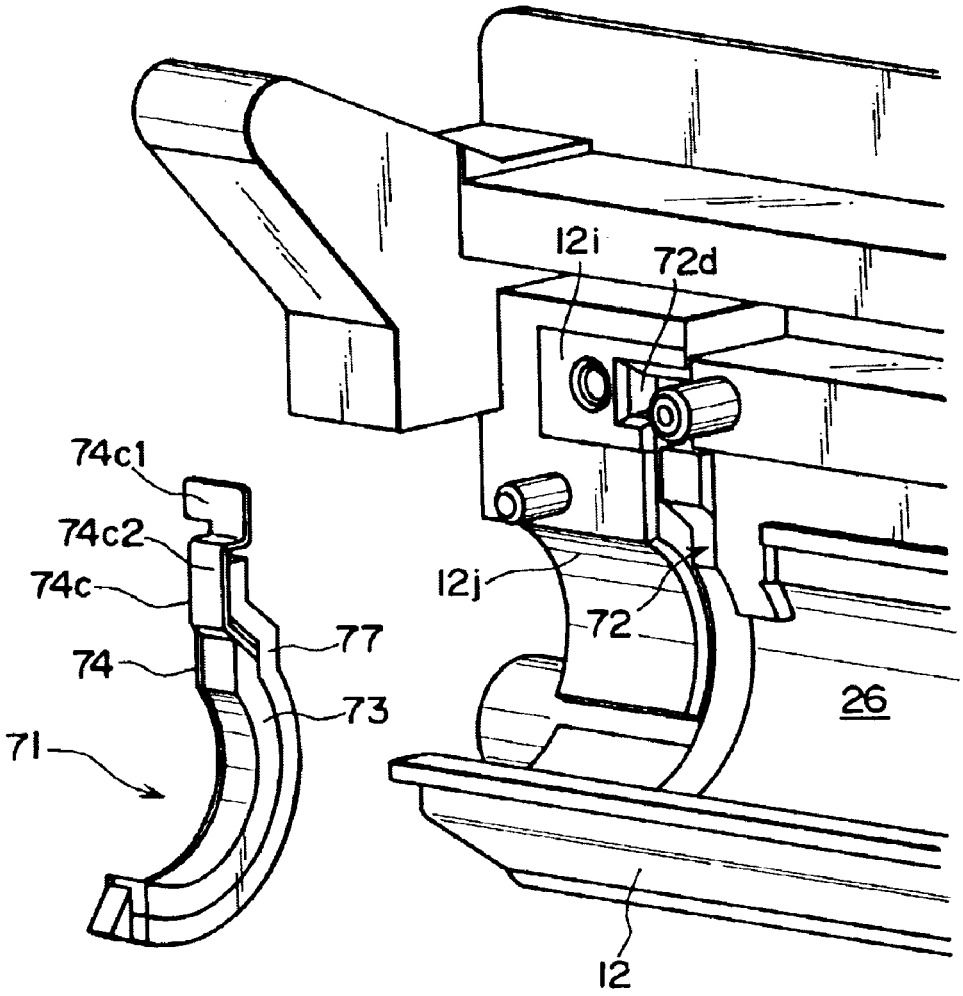
FIG. 4 is a perspective view of a mounting portion of the magnetic seal member according to Embodiment 1.

Further, the developing device frame 12 is provided with a mounting groove 72 for mounting the magnetic seal member 71, which groove extending from a flat surface 12*i* to an arcuate surface 12*j* as shown in FIG. 4. The mounting groove 72 has a shape shown in FIG. 5, and the shape corresponds to the cross section of the magnetic seal member 71, so that the elastic lining 77 exhibits the same compression amount over its entire area (with respect to the arcuate portion 71*a* and the linear portion 71*b* of the magnetic seal member 71 and the positioning portion 74*c* of the magnetic plate 74. Further, as shown in FIG. 4, at an entrance of the mounting groove 72 (positioning groove 72*d*) as an entering portion for the positioning portion 74*c*, a relatively large C surface (oblique surface) is provided so as to permit easy entrance of the upper end surface (a first positioning portion for positioning the magnetic seal member relative to the frame in a substantially vertical direction) of the positioning portion 74*c* of the magnetic seal member 71 into the upper end surface 72*g* of the groove 72.

As shown in (a) of FIG. 5, the magnetic seal member 71 is engaged into the mounting groove 72 (for mounting the magnetic seal member 71) of the developing device frame 12 as indicated by an arrow. Then, an arcuate portion 71*a* of the magnetic seal member 71 is fitted into an arcuate groove 72*a*, and a linear surface portion 71*b* of the magnetic seal member 71 is fitted into a linear groove 72*b*, as shown in (b) of FIG. 5. At this time, a boundary portion 71*n* (FIG. 1) between the linear portion 71*b* and the positioning portion 74*c* of the magnetic plate 74 is an oblique surface, thus resulting in smooth mounting in the mounting groove 72 at the time of assembly. When the magnetic seal member 71 is lightly pressed in a direction of an arrow A, a lower portion 77*a* (FIG. 2) of the elastic lining 77 is compressed. At the same time, the lower end surface 71*f* of the magnetic seal member 71 presses the lower end abutting portion 72*f*, and the bent engage portion 74*c*1 of the positioning portion 74*c* of the magnetic seal member 71 is flush with the groove 72*d*. Accordingly, when the abutting surface 74*c*2 (a second positioning portion for positioning the magnetic seal member relative to the frame in the insertion direction) of the magnetic seal member 71 is pushed toward the rear side in the direction (right-hand direction, i.e., insertion direction) crossing the arrow A, the magnetic seal member 71 is engaged with the groove 72 as shown in (c) of FIG. 5.

At the time of the pressing, a heavier load than that at the time of actual operation is applied to the magnetic seal member 71. In order to pass the bent engage portion 74*c*1 of the positioning portion 74*c* of the magnetic seal member 71 to the entrance to the groove 72*d*, the lower portion 77*a* of the elastic lining 77 has to be compressed when compared with the time of actual operation.

Figure 11:
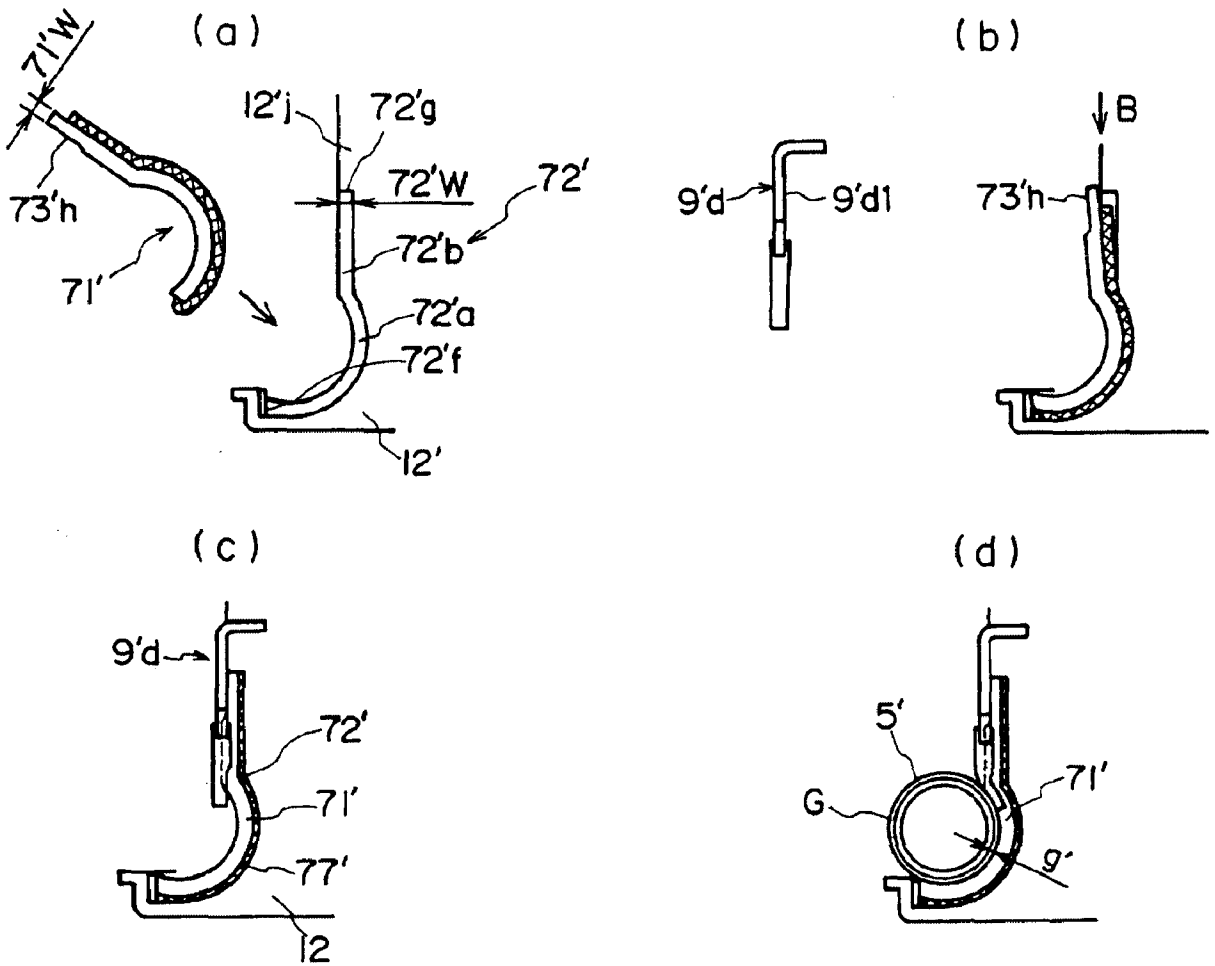
FIG. 11 is a side view illustrating mounting of the conventional magnetic seal member to a developing device frame.

Particularly, in the case of the conventional magnetic seal member 71', the magnetic seal member 71' does not enter the groove 72*d* if it is further pressed downwardly from the state of (b) of FIG. 11. However, in the case of the conventional magnetic seal member, a load is liable to be applied to the magnet portion of the magnetic seal member to damage the magnetic seal member.

On the other hand, in this embodiment, the bent engage portion 74*c*1 is thin and is liable to enter the groove 72*d* due to the C surface provided to the entrance of the groove 72*d*. In addition, the positioning portion 74*c* of the magnetic seal member 71 is a thin plate of SUS (stainless steel), thus being capable of being somewhat elastically deformed to be expected to improve an assembling performance. Further, the load applied to the magnetic portion 73 of the magnetic seal member 71 is reduced when compared with the conventional magnetic seal member 71'. Incidentally, the degree of the elastic deformation of the positioning portion 74*c* of the magnetic seal member 71 is minute and the load applied to the magnetic seal member 71 becomes smaller after the mounting, so that an amount of the deformation of the positioning portion 74*c* after the mounting is negligible.

Then, a developing blade 9*d* is mounted to the developing device frame 12. When a plate 9*d*1 of the developing blade 9*d* is closely contacted to the flat (bearing) surface 12*i* of the developing device frame 12, the abutting surface 74*c*2 of the positioning portion 74*c* is pressed by the plate 9*d*1 of the developing blade 9 as shown in (c) of FIG. 5, whereby the bent engage portion 74*c*1 of the positioning portion 74*c* of the magnetic seal member 71 is pressed into the groove 72*d*.

This rotates the upper portion of the magnetic seal member 71 about the lower end surface 71*f*, so that the elastic lining 77 is compressed rearwardly. The reaction force thereof is received by the lower end abutting portion 72*f* of the groove 72 of the developing device frame 12 to which the lower end surface 71*f* of the magnetic seal member 71 is contacted and by the plate 9*d*1 to which abutting surface 74*c*2 of the magnetic plate 74 is contacted. Then, a developer roller unit G is mounted. This is shown in (d) of FIG. 5.

As a result, the magnetic seal member 71 is held by the mounting groove 72 (for mounting the magnetic seal member 71) provided in the developing device frame 12 and the abutting surface 74*c*2 of the magnetic plate 74 is pressed by the plate 9*d*1 of the developing blade 9*d*, thus being correctly positioned.

As described above, in this embodiment, the magnetic seal member 71 is formed of the magnetic plate 74, not the magnet 73 at the portion other than the portion (the arcuate portion) to be opposite to the peripheral surface of the developing sleeve 5, so that the amount of use of expensive magnet can be decreased to cut down on costs.

Further, in this embodiment, a part of (the magnetic plate of) the magnetic seal member, i.e., the portion other than the portion opposite to the developing sleeve 5, is designed to be elastically deformable, thus improving the assembling performance. In addition, a probability of breakage of the magnetic seal member by the load applied at the time of the assembling is smaller than the case of the conventional magnetic seal member.

Incidentally, in this embodiment, the magnetic plate 74 located or the outer side of the magnet 73 is integral with the magnetic plate of the positioning portion since a single magnetic plate is subjected to bending to provide such magnetic plate portions. However, the magnetic plate 74 may be one which is not integral with the magnetic plate of the positioning portion.

[Other Embodiments]

In the above embodiment, as the process cartridge detachably mountable to the main assembly of the image forming apparatus, the process cartridge including the photosensitive drum and process means, acting on the photosensitive drum, which includes the charging means, the developing means and the cleaning means, integrally supported together with the photosensitive drum, is described but it is possible to employ a process cartridge including, in addition to the photosensitive drum and the developing means, either one of the charging means and the cleaning means.

Further, in the above embodiment, the process cartridge including the photosensitive drum, detachably mountable to the image forming apparatus main assembly but it is possible to independently mounting the respective constitutional components (means) to the image forming apparatus or such constitutional components may be those independently detachably mountable to the image forming apparatus.

Further, the image forming apparatus is the printer in the above embodiment but is also applicable to other image forming apparatus such as a copying machine, a facsimile apparatus and multiple function processing machine including functions of the copying machine and the facsimile apparatus.

Furthermore, the present invention is not limited to the above described embodiments, and variations and modifications may be made within the scope of the present invention.

What is claimed is:

1. A developing apparatus, comprising:

a roller-shaped developer carrying member;

a frame for holding said developer carrying member; and a magnetic seal member for preventing leakage of a developer from an end of said developer carrying member in a longitudinal direction of said developer carrying member, wherein said magnetic seal member includes an arcuate magnet portion to be disposed along a circumferential direction of said developer carrying member, and a non-arcuate portion which extends from an end, in the circumferential direction, of said magnet portion away from a peripheral surface of said developer carrying member, and wherein said non-arcuate portion is made of a material different from said magnet portion.

2. An apparatus according to claim 1, wherein said non-arcuate portion comprises a magnetic member.

3. An apparatus according to claim 2, wherein said non-arcuate portion is made of stainless steel.

4. An apparatus according to claim 2, wherein said magnetic seal member further includes a magnetic member provided at an outer side surface of said magnet portion in the longitudinal direction.

5. An apparatus according to claim 4, wherein said magnetic member of said non-arcuate portion is integral with said magnetic member provided at said outer side surface, and wherein said magnetic members are formed by bending a single magnetic plate.

6. An apparatus according to claim 1, wherein said non-arcuate portion positions said magnetic seal member relative to said frame.

7. An apparatus according to claim 6, wherein said non-arcuate portion includes a first positioning means for positioning said magnetic seal member in a substantially vertical direction, and a second positioning means for positioning said magnetic seal member in an insertion direction.

8. An apparatus according to claim 7, further comprising a metal plate which abuts to said second positioning means and is in a noncontact state with said first positioning means.

9. An apparatus according to claim 8, wherein said metal plate supports a blade for regulating a layer thickness of a developer to be carried on said developer carrying member.

10. An apparatus according to claim 1, wherein said non-arcuate portion is elastically deformable.

11. A magnetic seal member adapted to a developing apparatus, said magnetic seal member comprising:

an arcuate magnet portion to be disposed along a circumferential direction of a developer carrying member; and a non-arcuate portion which extends from an end, in the circumferential direction, of said magnet portion away from a peripheral surface of said developer carrying member, wherein said non-arcuate portion is made of a material different from said magnet portion.

12. A magnetic seal member according to claim 11, wherein said non-arcuate portion comprises a magnetic member.

13. A magnetic seal member according to claim 12, wherein said non-arcuate portion is made of stainless steel.

14. A magnetic seal member according to claim 12, further including a magnetic member provided at an outer side surface of said magnet portion in the longitudinal direction.

15. A magnetic seal member according to claim 14, wherein said magnetic member of said non-arcuate portion is integral with said magnetic member provided at said outer side surface, and wherein said these magnetic members are formed by bending a single magnetic plate.

16. A magnetic seal member according to claim 11, wherein said non-arcuate portion positions said magnetic seal member relative to said frame.

17. A magnetic seal member according to claim 16, wherein said non-arcuate portion includes a first positioning means for positioning said magnetic seal member in a substantially vertical direction, and a second positioning means for positioning said magnetic seal member in an insertion direction.

18. A magnetic seal member according to claim 17, wherein the second positioning means abuts a metal plate for fixing said magnetic seal member to said frame of said developing apparatus, and wherein said first positioning means is in a noncontact state with said metal plate.

* * * * *

UNITED STATES PATENT AND TRADEMARK OFFICE

CERTIFICATE OF CORRECTION

PATENT NO. : 6,968,138 B2
DATED : November 22, 2005
INVENTOR(S) : Takashi Akutsu It is certified that error appears in the above-identified patent and that said Letters Patent is hereby corrected as shown below:

Column 1,
Line 20, “o” should read -- on --.

Column 5,
Line 47, “These” should read -- This --.

Column 6,
Line 46, “developer” should read -- developing --.

Column 9,
Line 32, “or” should read -- on --.

Column 11,
Line 5, “these” should be deleted.

Signed and Sealed this

Twenty-fifth Day of April, 2006

JON W. DUDAS
*Director of the United States Patent and Trademark Office*